US010760290B1

(12) United States Patent
Bennett

(10) Patent No.: US 10,760,290 B1
(45) Date of Patent: Sep. 1, 2020

(54) PLUNGER WAVE MAKING APPARATUS

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 0 days.

(21) Appl. No.: 16/873,131

(22) Filed: Feb. 10, 2020

(51) Int. Cl.

| | |
|---|---|
| ***F04D 35/00*** | (2006.01) |
| ***E04H 4/00*** | (2006.01) |
| ***F04D 33/00*** | (2006.01) |
| *A63B 69/00* | (2006.01) |

(52) U.S. Cl.
CPC ..... *E04H 4/0006* (2013.01); *F04D 33/00* (2013.01); *F04D 35/00* (2013.01); *A63B 69/0093* (2013.01)

(58) Field of Classification Search
CPC . E04H 4/0006; A63B 69/0093; A63B 69/125; F04D 35/00
USPC ..... 405/79; 4/491
See application file for complete search history.

(56) References Cited

U.S. PATENT DOCUMENTS

| | | | | |
|---|---|---|---|---|
| 3,350,724 | A | 11/1967 | Leigh | |
| 3,789,612 | A | 2/1974 | Richard | |
| 3,973,405 | A | 8/1976 | Duport | |
| 4,229,969 | A * | 10/1980 | Hark | G01M 10/00 4/491 |
| 4,276,664 | A | 7/1981 | Baker | |
| 4,806,048 | A * | 2/1989 | Ito | E04H 4/0006 405/79 |
| 4,810,129 | A * | 3/1989 | Guevel | E04H 4/0006 4/491 |
| 8,434,966 | B1 | 5/2013 | McFarland | |
| 9,103,133 | B2 | 8/2015 | McFarland | |
| 9,556,633 | B2 | 1/2017 | Lochtefeld | |
| 9,777,494 | B2 | 10/2017 | Lochtefeld | |
| 9,920,544 | B1 | 3/2018 | Bennett | |
| 9,926,712 | B2 * | 3/2018 | Oshibe | E04H 4/0006 |
| 10,501,951 | B2 | 12/2019 | Trevis | |
| 10,519,679 | B1 | 12/2019 | Bennett | |
| 2014/0189948 | A1 | 7/2014 | Lochtefeld | |
| 2017/0204627 | A1 | 7/2017 | Trevis | |

FOREIGN PATENT DOCUMENTS

| | | | | |
|---|---|---|---|---|
| WO | WO-2015188219 | A1 * | 12/2015 | A63B 69/0093 |
| WO | WO02015188219 | A1 | 12/2015 | |
| WO | WO-2016129107 | A1 * | 8/2016 | A63B 69/0093 |

* cited by examiner

*Primary Examiner* — Frederick L Lagman

(57) ABSTRACT

A plunger wave making apparatus for creating a surface wave in a body of water. The waves are generated by a plurality of side by side individual plungers oscillating up and down, placed along different shapes such as a linear straight line, square, polygon, triangle and hexagon shapes. Plunger Wave Makers oscillating at individual different times in a non-sequence manner and oscillating in sequence one plunger at a time in a delayed actuation. The plungers have the ability to produce swells in different directions. The plunger wave making apparatus is made of an internal steel structure with EPS Geo Foam secured to the outside of the steel internal structure with end caps. Ballast Water is placed inside the inner steel structure of the plungers to offset upward buoyancy forces. The wave making plungers are placed on a back wall angled between 30-90 degrees.

5 Claims, 10 Drawing Sheets

PLUNGER WAVE MAKING APPARATUS

BACKGROUND OF THE INVENTION

There are many ways to generate waves into a body of water for the purpose of surfing, body boarding and body surfing and other water sport activities. The main ways artificial waves are generated in a body of water are vacuum water drop systems, pneumatic wave making chamber systems, air blower machines, flap wave makers, piston module wave makers that push forward and backward, plow type wave makers, pulled along on a track by a cable or motor, hydrofoil wave makers and plunger type wave makers. The current plunger wave makers for producing waves for surfing, are very expensive to fabricate and very expensive to construct and assemble.

The current plunger wave making inventions for producing waves for surfing in a body of water are Bennett, Bushey, Gunn U.S. Pat. No. 9,920,544B1 and Aaron Trevis, Patent No's 20170204627A1 and U.S. Pat. No. 10,501,951. Again, these plunger wave makers are very expensive to build and fabricate and are very expensive to construct and assemble. Previous wave making plunger inventions lack the ability to be placed along different shapes, produce waves in various angles and directions. The current inventions solve these problems.

PRIOR ART

In U.S. Pat. No. 9,920,544, Bennett, Bushey and Gunn, is a plunger wave maker that is made out of steel panels, that uses a hydraulic actuator connected to a belcrank and drive link mechanism to push down and pull up the plungers. This patent teaches away from the current invention, because the current invention uses an internal steel structure with four sides (front, 2 sides and a bottom), with geofoam secured to the inner steel structure by using end caps. The hollow inside portion created from the inner steel structure is used to fill with water ballast to offset upward buoyancy forces.

In U.S. Patents 20170204627A1 and WO2015188219A1, Trevis, the invention provides wave generation by the means of a solid circular plunger. The solid plunger generates at least one wave in a surface of a body of water, comprising at least one wave generating object, means for causing the wave generating object to oscillate vertically relative to the surface, with the wave generating object in contact with the body of water for at least some of the time. Trevis teaches away from the current invention, because this patent does not claim oscillating individual side by side plungers at different times as in the current invention. Trevis does not teach, claim nor illustrate individual oscillating individual plungers operating along different shapes, such as liner straight line, angled lines, circles, semi circles, arc shapes as in the current invention. Trevis does illustrate in a circular design however oscillates as one single solid plunger. Trevis also does not teach, claim nor illustrate oscillating individual plungers in a delayed actuation sequence (one plunger at a time), as the current invention claims.

In U.S. patent Ser. No. 10/501,951, Trevis, is a plunger wave generating system for use in a wave pool defining a body of water having a water surface and a shoreline, the wave generating system comprising a plunger having movable portions for adjusting a side cross section profile of the plunger by changing a shape of the plunger wherein the movable portions are adjustable relative to one another to define a large profile of the plunger and a small profile of the plunger. Trevis teaches away from the current invention, because this patent does not claim oscillating individual side by side plungers oscillating at different times as in the current invention. Trevis does not teach, claim nor illustrate individual oscillating individual plungers operating along different shapes, such as liner straight line, angled lines, circles, semi circles, arc shape as in the current invention. Trevis does illustrate in a circular design, however oscillates as one single solid plunger unit. Trevis also does not teach, claim nor illustrate oscillating individual plungers in delayed actuation sequence (one plunger at a time), as the current invention claims.

In U.S. Pat. No. 10,519,679B1 Bennett, a wave making plunger constructed of solid geofoam and fiberglass. Bennett, teaches away from the current invention because in Bennett the plungers are made of all geofoam or geofoam covered with Fiberglass coating. The invention also has self-filling water ballast holes. In the current invention is completely different, as the internal portion of the plunger is a four-sided steel inner structure with geofoam blocks attached to the outer part of the steel structure via bolted end caps.

In U.S. Pat. No. 3,350,724 Walter Leigh, apparatus for generating waves in a body of water comprising a pair of spaced, normally upright walls to be placed in said body of water, said walls being vertically diminished to protect a distance above the water surface, a wave generating unit including wave generating means between said walls adjacent one end thereof for generating in said water a wave motion which travels outwardly from said generating means between said walls.

In U.S. Pat. No. 3,973,405A, Duport, improvements to surge generators of the plunger type for generating surge a test tank, consisting in imparting to the said plunger a movement through an angle in relation to the vertical position. The direction of the inclination being such that the low part of the path of the plunger is in front of the top part of that path, in relation to the direction of propagation of the surge emitted, the clearance between the lateral walls of the plunger and the corresponding walls of the test tank being slight. The inclined movement is obtained, by the sliding of the rear face of the plunger on a inclined plane with a continuous wall, that rear face having the same inclination as the said inclined plane, the direction of the inclination being such that the lowest generating line is in front of the highest generating line in relation to the direction of propagation of the surge emitted.

In U.S. Pat. No. 3,789,612 Richard, the wave generator is a buoyant plunger mounted for vertical reciprocation within a chamber having a shoreward facing opening. Through a cyclic control system, the plunger is driven in phase with the forces of gravity and buoyancy acting thereon, starting from a rest position through strokes of increasing amplitude until a desired steady state is attained to sequentially produce waves of a desired energy. Provision is made for varying the mass of the plunger and varying the input from a prime mover as a means of adjusting wave energy and frequency.

In U.S. Pat. No. 4,276,664 Baker, an apparatus is provided for making waves in bodies of water used for swimming, having a plurality of hollow open-bottom piston plungers mounted for reciprocation in alternating power and suction strokes in which the movement of each piston engaged in a power stroke is opposed to the movement of an adjacent piston engaged in a suction stroke; each piston confining a gas cushion between the top and any water within the tower portion of the piston that is under a super atmospheric pressure during a power stroke of the piston, and under a sub atmospheric pressure during a suction stroke of the piston;

whereby on the suction stroke each piston draws water into its interior via its passage and port from the body of water, and on the power stroke each piston pushes water from its interior via its passage and port back into the body of water, the resulting alternating pulses of water flow generating waves in the body of water.

In U.S. Pat. No. 8,434,966B1 McFarland & U.S. Pat. No. 9,103,133B2 American Wave Machines, a wave generating apparatus and method is provided in which a controller actuates a plurality of wave generating chambers in sequence using a delay between actuation of each chamber to produce a rideable wave in a pool. The actuation delay period may be a predetermined proportion of the chamber period. The amount of delay in the sequence can determine the direction that the peak of the wave travels and the amplitude of the peak. Through the sequencing, the peak of the wave produced can travel in a direction not substantially perpendicular to the wave generating chambers. McFarland teaches away from the current invention, as the current invention uses a plurality of individually plungers to oscillate the plungers one at a time down the line of plungers. The current invention also teaches of oscillating a plurality of side by side plungers at different times, not in sequence to produce a swell that is broken over a contoured artificial reef bottom to produce surfing waves. Where as in McFarland, the patent teaches of using air blowers pneumatic wave chambers and using a computer control to delay the firing of each wave chamber in sequence.

In U.S. Pat. No. 9,777,494B2 & 20140189948A1 Thomas J. Lochtefeld & Dirk Bastenhof, the disclosure relates to a method and apparatus for a wave pool having a deep end and a shallow end, wherein a plurality of pneumatic air blower wave generators is provided for producing wave segments in the wave pool. The wave generators are preferably extended substantially along the deep end in a substantially staggered manner relative to the travel direction of the wave segments. A pair of dividing walls is preferably provided in front of each wave generator, wherein the dividing walls are extended substantially forward in the travel direction and substantially parallel to each other or with a fade angle of no more than about 20 to 30 degrees relative to each other. The wave generators are preferably operated in sequence from one side of the pool to the other, such that a plurality of pneumatic wave segments is generated at pre-selected time intervals, and such that the plurality of wave segments can travel forward and then, due to the stagger of the wave generators, merge together to form a substantially uniform resultant periodic wave. The resultant wave forms and travels forward and then breaks along the shallow end which preferably comprises a break line.

Lochtefeld and Bastenhof teach away from the current invention, because they teach of using a pair of dividing walls in front of each wave generator extended substantially forward in a staggered fashion causing the swell to converge. The current invention uses individual plunger wave makers placed side by side but are not in a staggered fashion and do not cause the swell to converge. The current invention also does not use dividing walls extended out from the plungers. Lochtefeld and Bastenhof do not teach of using plunger wave makers, in a non-staggered fashion (side by side) that have the ability of a plunger wave makers oscillating in sequence and non sequence to produce waves from different directions and angles. Lochtefeld and Bastenhof also do not teach of side by side plurality of wave making plungers oscillating individually in a delayed actuation sequence. However, rather in contrast teach of staggered wave chambers that produce waves in sequence for the purpose of merging and converging a swell to create a wave.

In U.S. Pat. No. 9,556,633B2, Thomas J. Lochtefeld & Dirk Bastenhof, of a wave pool having a deep end and a shallow end with a plurality of wave generators along the deep end that are extended along a curved stagger line positioned at an oblique angle relative to the moving waves. The wave generators are preferably extended in a substantially staggered manner relative to the travel direction of the waves. A pair of dividing walls is preferably provided in front of each generator, wherein the dividing walls are extended substantially forward with an outward fade angle of no more than about 20 degrees relative to each other. The wave generators are preferably operated in sequence, such that a plurality of wave segments is generated, and such that the wave segments travel forward and then merge together to form a substantially uniform resultant wave which travels forward and then breaks along the shallow end.

SUMMARY OF THE INVENTION

The current invention is a plunger wave maker for pushing a swell into a body of water for the purpose to generate waves for surfing, body boarding, body surfing and other water activity sports such as but not limited to kayaking, wake boarding, paddling boarding, jet skiing, wave runners. Other plunger wave generators are complicated and expensive to fabricate and very expensive to construct and assemble. Other plunger wave makers do not have the capability to produce a swell from different directions or to operate their plungers individually in a delayed sequence. The current invention has the solution and improvements to these problems.

The current invention is made out of an inner four-sided steel structure. The inner four sides are a front panel, two side panels and a back panel. The inner steel structure is hollow and EPS (Expanded Polystyrene) geofoam is used and is attached to the front and two sides of the steel inner structure by means of steel end caps. There are holes in the EPS geofoam which the steel end caps slide through and bolt to the outside of the four inner steel panels. The end caps are what attach the EPS geofoam permanently to the inner steel structure. The current invention is a huge improvement over other plunger wave makers, because the current invention is very easy to fabricate, as the plungers have very little parts to produce the plungers and the wheel assemblies. The limited number of components greatly reduces the fabrication costs. The limited components also reduce assembly time out in the field on site and also reduce contractor cost and time to construct and assemble the plunger wave makers. A huge improvement to other plunger wave maker inventions. Other plunger wave maker inventions have limited ability to how they are shaped. Most plunger inventions are linear straight lines or in circle shaped, such as in U.S. patent Ser. No. 10/501,951, Trevis. However, in Trevis the plunger is one solid circle plunger unit and is not individual side by side plungers as in the current invention. The current invention has greatly improved the ability to use a plurality of individual plungers along different shapes to produce a swell such as linear straight line, angled line, circle, semi-circle, and arc shapes and other shapes with multiple linear straight lines. The ability to have a plurality of plungers in different shapes gives more options to place the plungers on different sized and shaped bodies of water and to create many different surfable wave variations. The current plunger wave making invention can be set in a plurality of plungers' side by side.

DETAILED DESCRIPTION OF THE DRAWINGS

Figure 1:
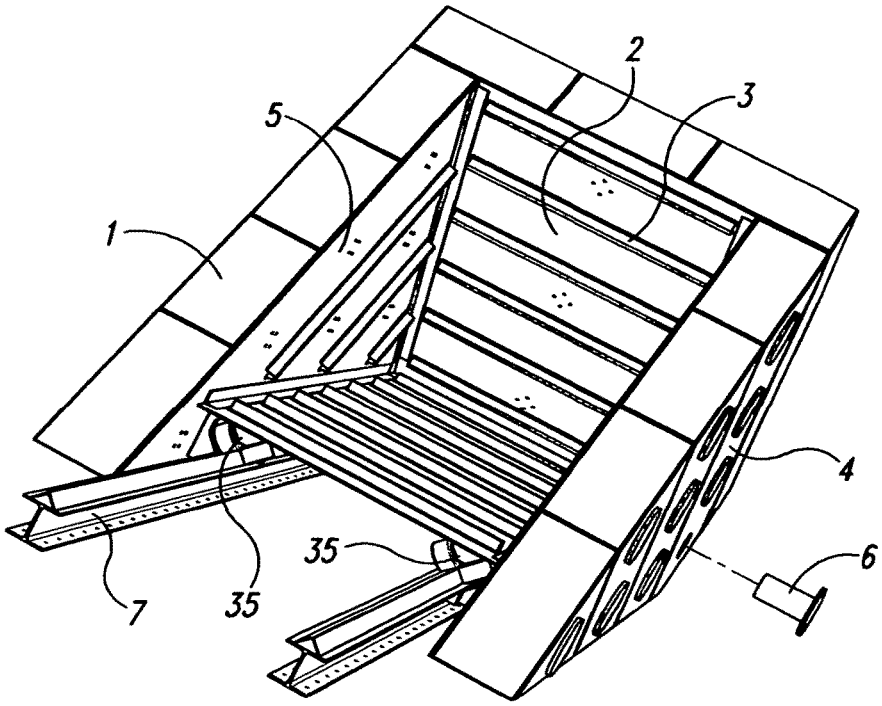
FIG. 1 is a top down view of the four-sided inner steel structure of the plungers with end caps.

FIG. 1 is a detailed description of the Plunger Wave Maker 1. The Plunger Wave Maker 1 has an inner steel structure 2. The inner steel structure 2 is strengthened by steel stiffeners 3. The inner steel structure 2, has four sides, a front, two sides, and a back. The outer structure of the Plunger Wave Maker 1 is made out of EPS geofoam 4. There are holes 5 in the EPS geofoam that allow the end caps 6 to fit through the holes 5 and bolt to the inner steel structure 2. The plunger wave maker runs on wide flange I-beams 7.

Figure 2:
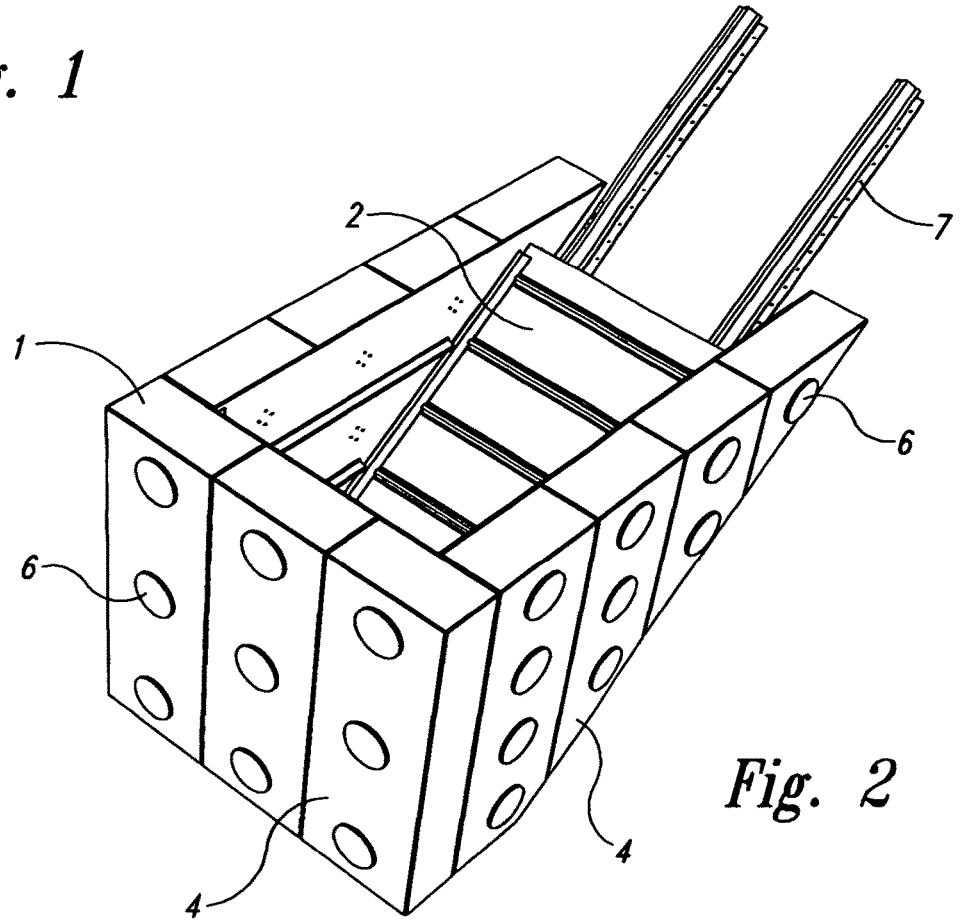
FIG. 2 is a side view of the EPS geofoam secured to the four-sided steel structure, showing end caps through the geofoam.

FIG. 2 is a detailed side view description of the Plunger Wave Maker 1. The Plunger Wave Maker 1 shows four pieces of the EPS geofoam blocks 4 at decreasing sizes from front to back on the side of the Plunger Wave Maker 1. There are end caps 6 that go through the EPS geofoam and bolt 10 to the inner steel structure 2. The front of the Plunger Wave Maker 1 has three blocks of EPS geofoam 4. The Plunger Wave Maker 1, oscillates on the wide flange I-beams 7.

Figure 3:
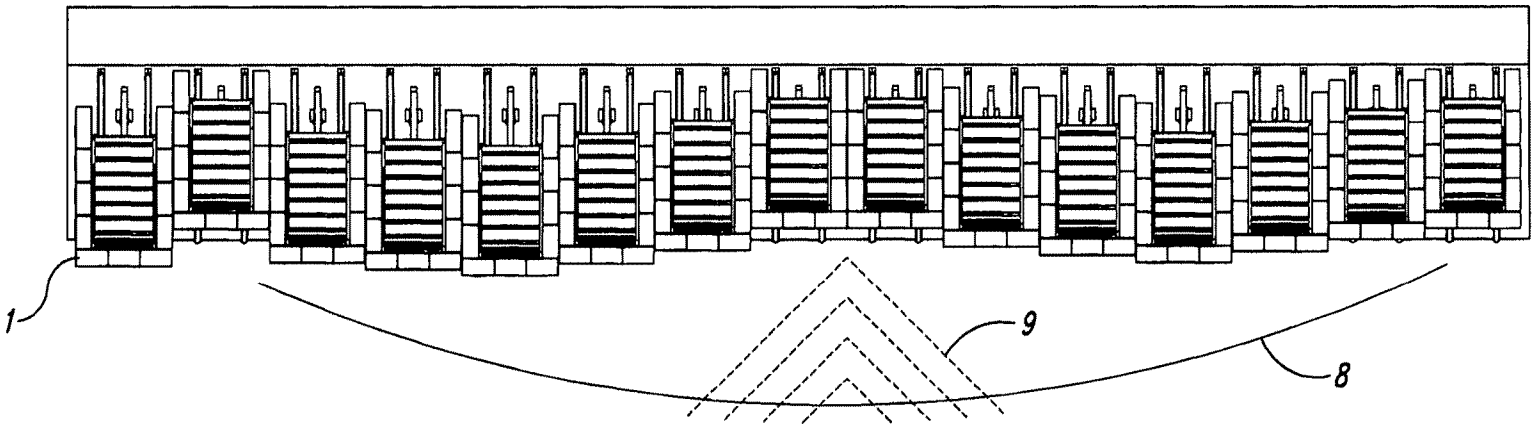
FIG. 3 is a top down view of a plurality of side by side plungers moving at different times.

FIG. 3 is a detailed top down view of a plurality of Plunger Wave Makers 1 side by side oscillating at different times. This particular oscillating array of Plunger Wave Makers 1, is pushing out a swell 8 diverging toward the middle and expanding outward. The converging swell 8 toward the middle breaks over the contoured bottom 9 to create a surfing wave.

Figure 4:
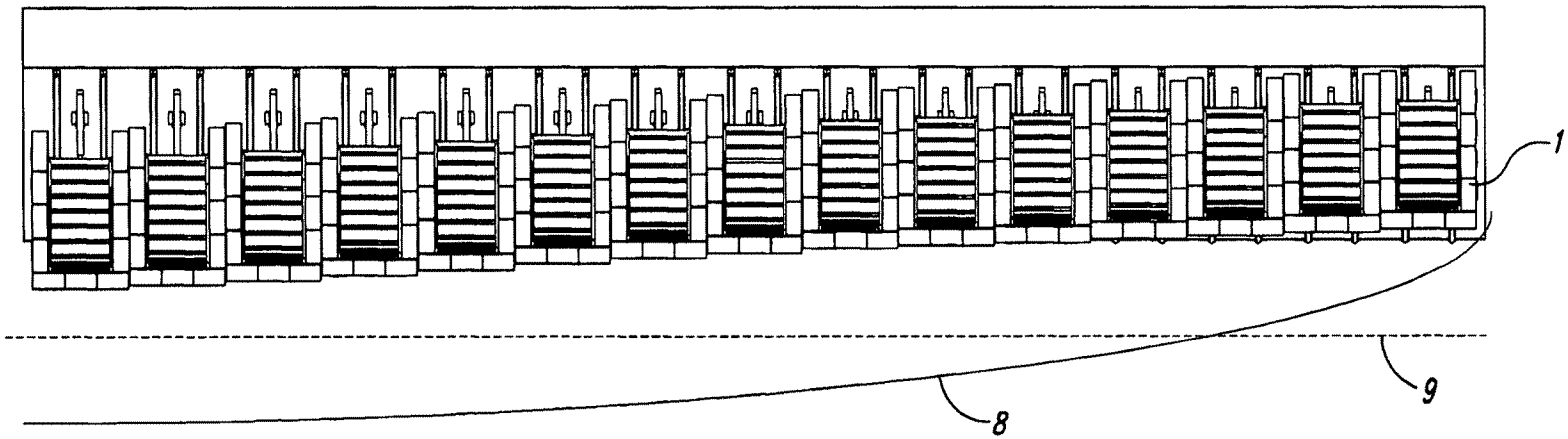
FIG. 4 is a top down view of a plurality of individual plungers oscillating in sequence with a slight delay between each plunger.

FIG. 4 is a detailed view of the Plunger Wave Makers 1 aligned side by side where there is a slight delay between actuation of each Plunger Wave Maker 1. This slight delay in actuation of the Plunger Wave Makers 1 causes the swell 8 to push out first on the left side before the right side of the plungers pushes out a swell 8. This slight delay in actuation of the Plunger Wave Makers 1 causes the swell 8 to break a wave along the contoured bottom 9.

Figure 5:
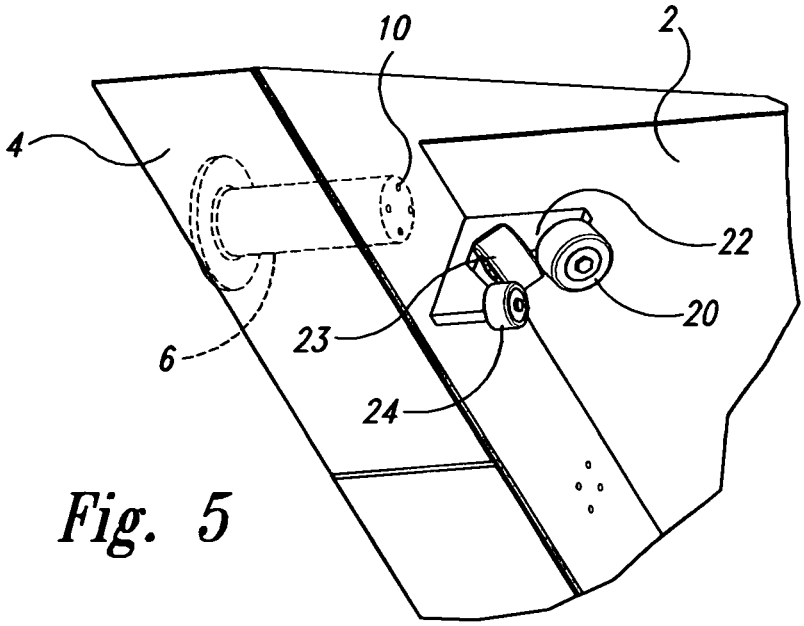
FIG. 5 is a cross sectional view of the end caps through the EPS geofoam bolting to the inner steel structure.

FIG. 5 is a cross sectional detailed view of the end caps 6 going through the EPS geofoam blocks 4 through the holes 5 and secured by bolts 10 to the inner steel structure 2. The wheel block 22 is attached to the bottom inner steel structure 2. Top wheels 22 and 23 are bolted to the wheel block 22. Bottom wheel 24 is attached to the wheel block 22.

Figure 6:
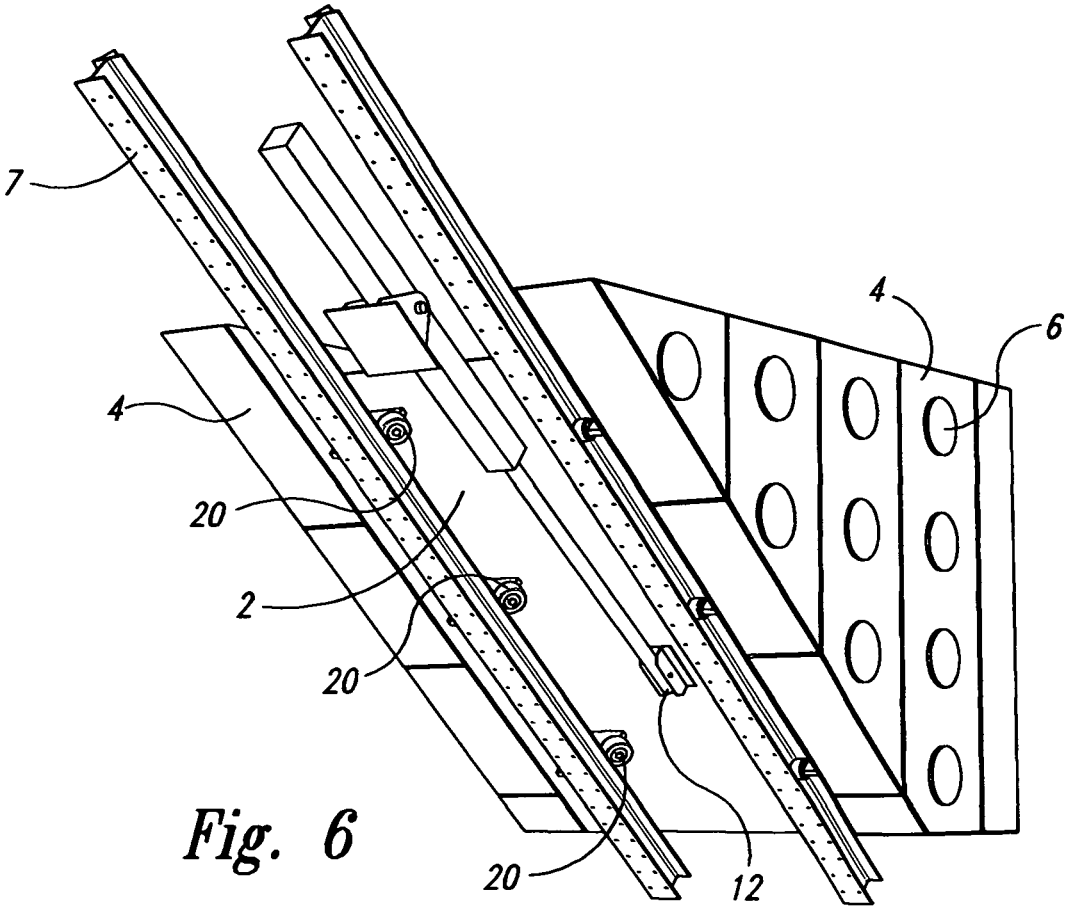
FIG. 6 is a bottom view of the Plunger Wave Maker showing the double ended hydraulic cylinder in actuation.

FIG. 6 is a bottom view of the Plunger Wave Maker 1. It shows the bottom steel panel of the inner steel structure 2. The Plunger Wave Maker is actuated by a double ended hydraulic cylinder 11 which attaches to the back-steel panel by means of a clevis 12.

Figure 7:
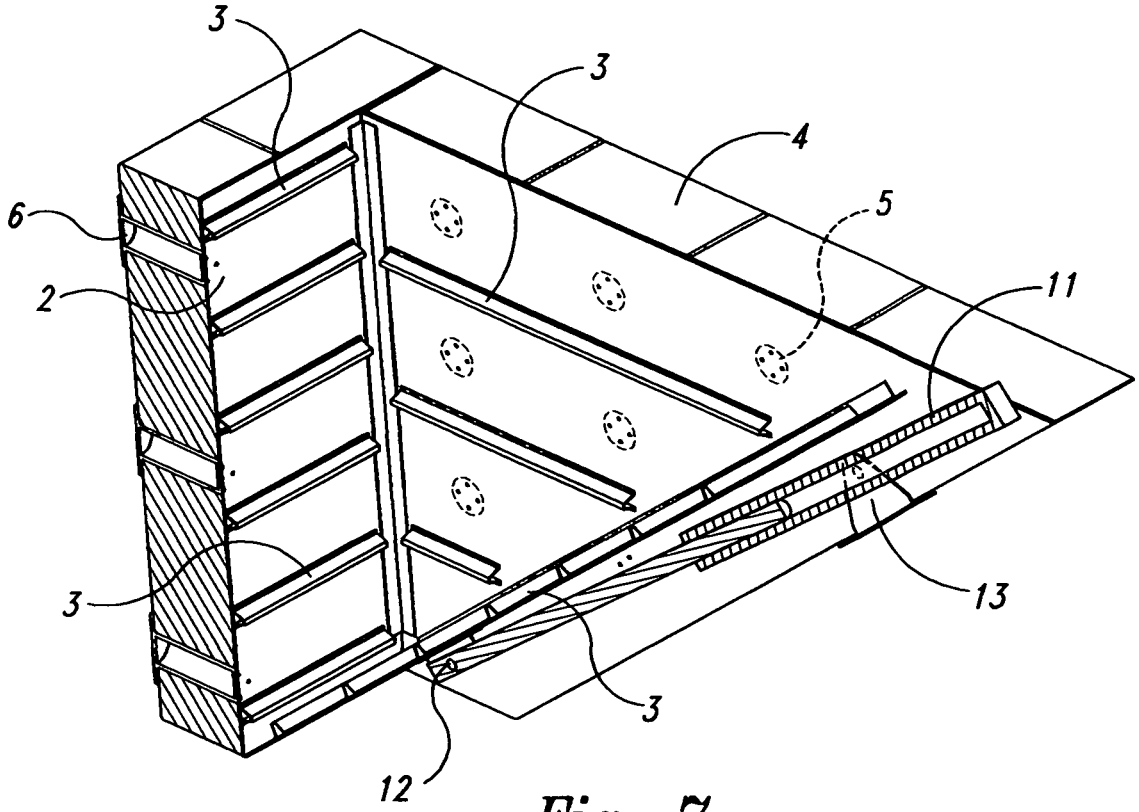
FIG. 7 is a cross sectional side view of the Plunger Wave Maker.

FIG. 7 is a cross sectional side view of the Plunger Wave Maker 1. The drawing details the steel stiffeners 3 on each panel of the inner steel structure 2. The drawing details the steel end caps 6 going through the holes 5 and connecting to the inner steel structure 2. The Plunger Wave Maker 1 is actuated by a double ended hydraulic cylinder 11 which is attached to a trunnion 13.

Figure 8:
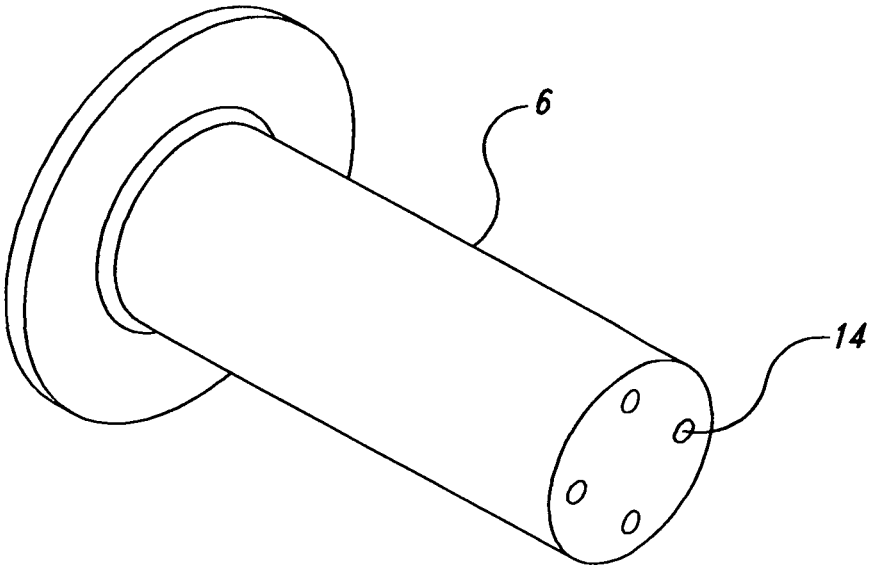
FIG. 8 is a side view of the steel end caps with bolt holes.

FIG. 8 is a side view of the steel end cap 6. The end cap 6 has four bolt holes 14.

Figure 9:
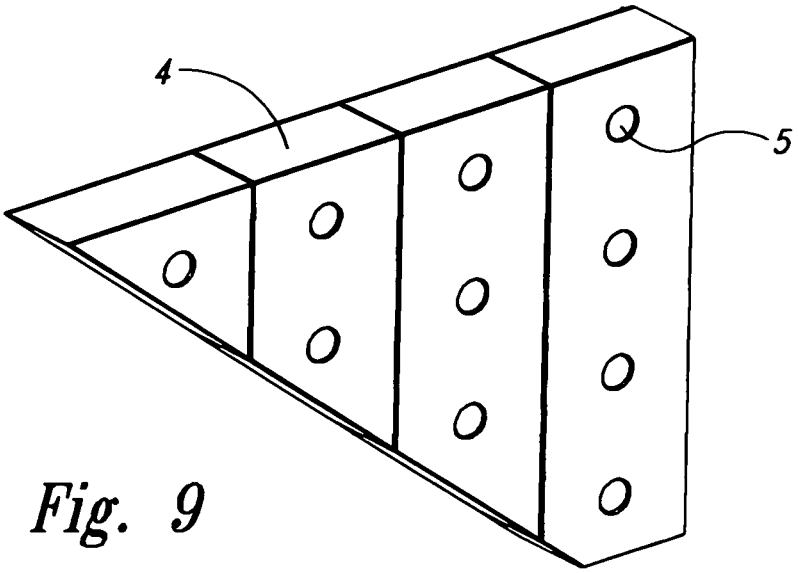
FIG. 9 is a side view of the side EPS geofoam piece that attaches to the inner steel structure of the Plunger Wave Maker.

FIG. 9 is a detailed side view of the four side EPS geofoam piece 4 that attaches to both sides of the inner steel structure 2 of the plunger wave maker 1. The geofoam 4 has holes 5 cut in each geofoam block 4.

Figure 10:
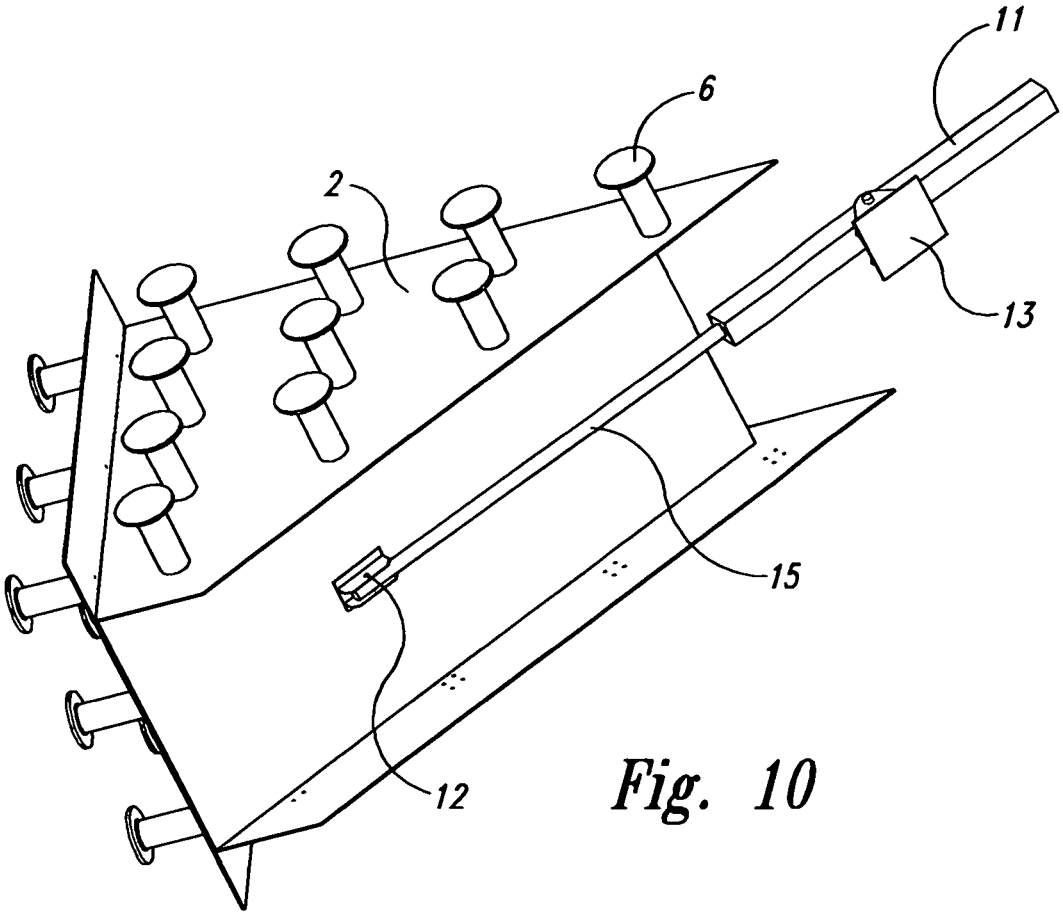
FIG. 10 is a side and bottom view of the inner steel structure without the geofoam blocks.

FIG. 10 is a side and bottom detailed view of the inner steel structure 2 of the Plunger Wave Maker 1. The drawing shows the end caps 6 bolted to the inner steel structure 2 without the EPS geofoam blocks. The drawing shows the rod 15 of the hydraulic cylinder 11 attached to a clevis 12.

Figure 11:
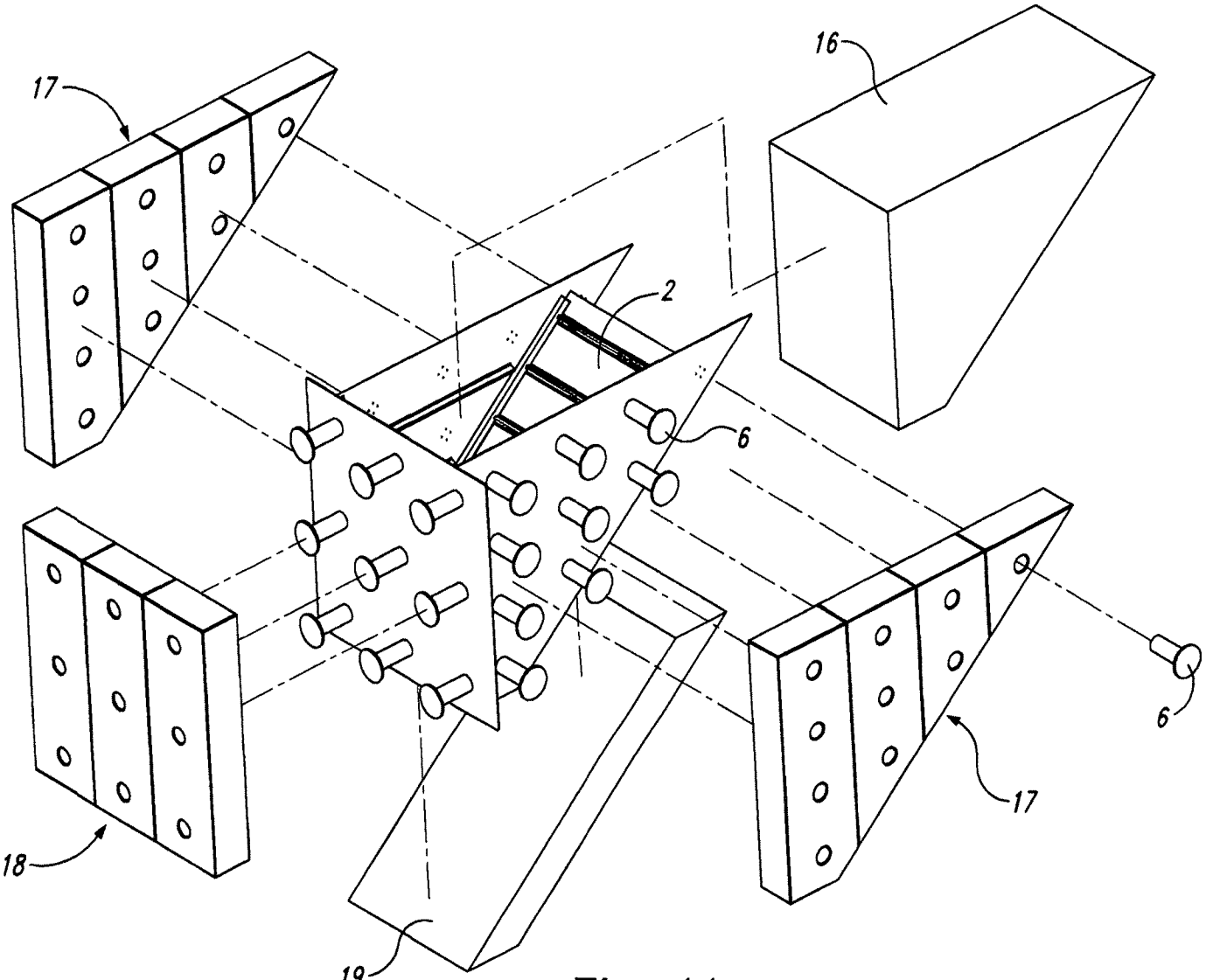
FIG. 11 is an exploded view of the Plunger Wave Maker.

FIG. 11 is an exploded detailed view of the Plunger Wave Maker 1. The four-sided internal steel structure 2 has end caps 6 that bolt to the inner steel structure 2. The four-sided inner steel structure 2, has four steel panels, two side EPS geofoam pieces 17, one front geofoam piece 18 and one bottom steel panel 19. The inner steel structure 2 is a hollow compartment that is filled with water ballast 16 to offset the upward buoyancy forces that are acted upon the plungers.

Figure 12:
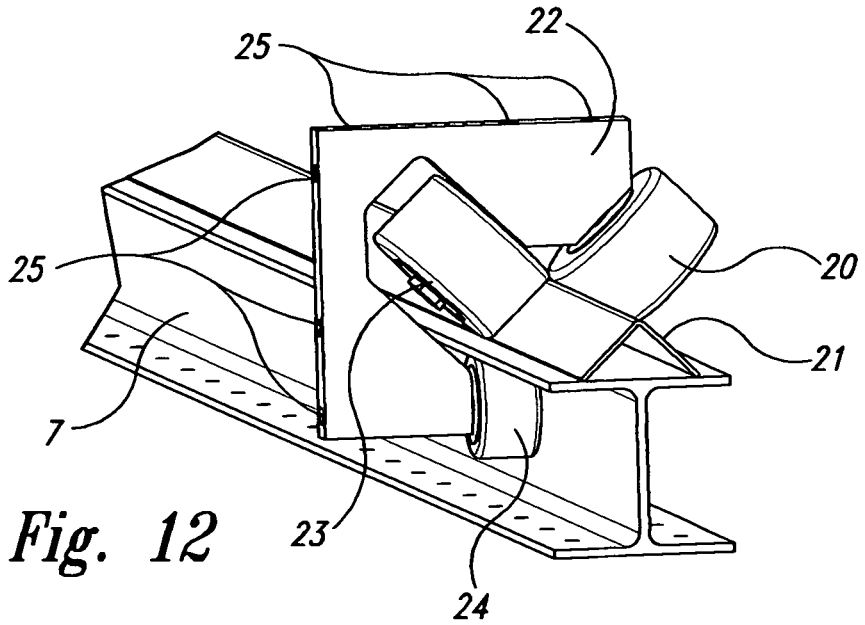
FIG. 12 top down view of the Plunger Wave Maker's wheel assemblies.

FIG. 12 is a top view of the wheel assemblies that are used to guide the Plunger Wave Maker 1. The wheel assembly runs on a wide flange I-beam guide rail 7. The bottom wheel 24 runs along the wide flange beam 7. The bottom and top wheels 20 are bolted to a wheel block 22. The wheels bolt 23 into the wheel block 22. The top two wheels 20 roll along a V shaped piece of steel 21, that is stitch welded to the wide flange beam 7. The wheel assemblies bolt to the bottom of the Plunger Wave Maker via holes 25 in the wheel block 22.

Figure 13A:
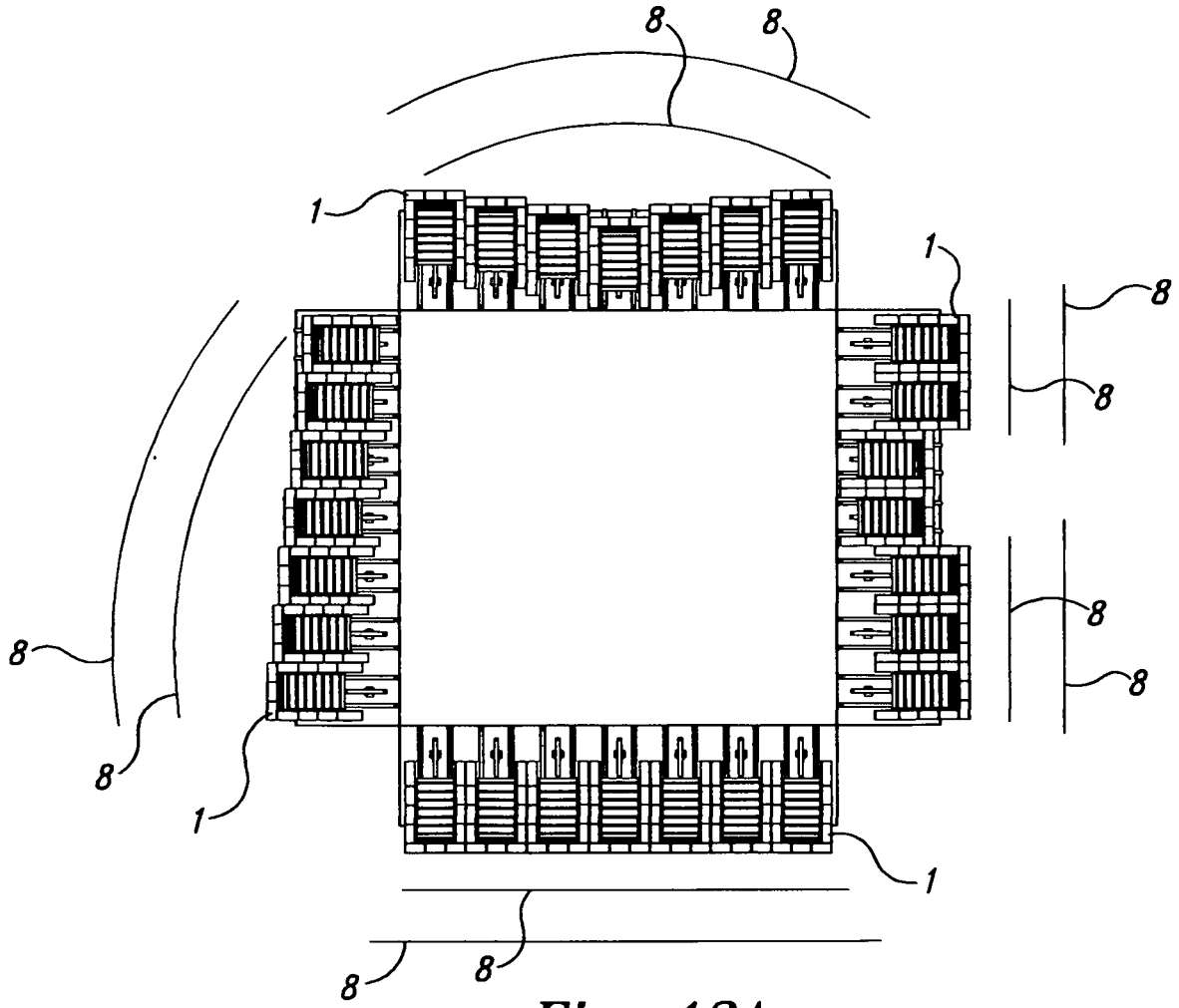
FIG. 13A is a top down view of a four sided square shaped structure with Plunger Wave Makers positioned along the straight linear lines of the square.

FIG. 13A A detailed view of Plunger Wave Makers 1 placed around a four sided square with four equal straight linear sides. The Plunger Wave Makers 1 can be placed along different linear straight-line sides of the square. The Plunger Wave Makers 1 can oscillate in sequence with a delayed actuation or they can oscillate in a non sequence manner to push a swell 8 into a body of water on each side of the square. Each liner straight line side of the square can have a different kind of swell 8 in different directions.

Figure 13B:
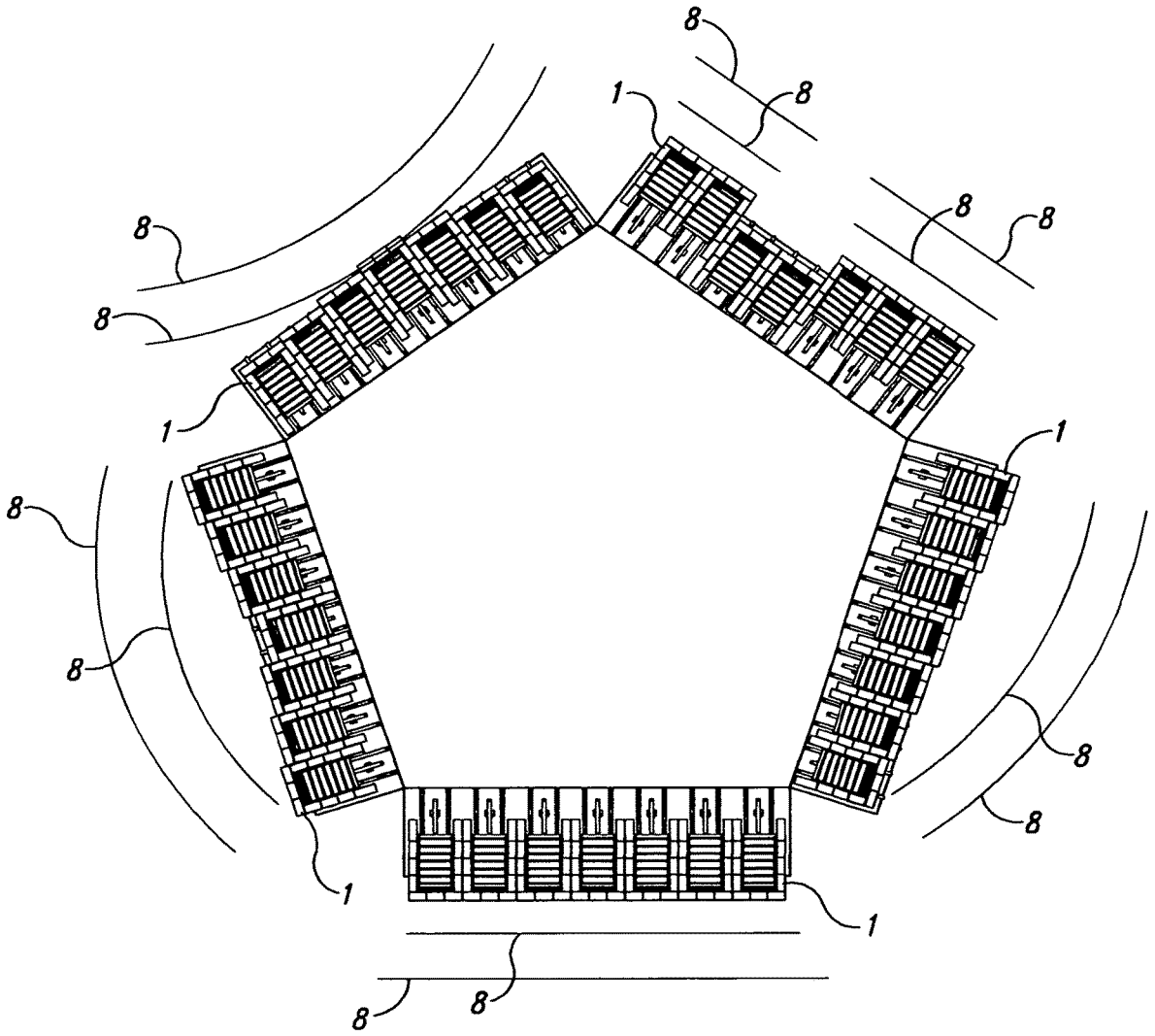
FIG. 13B is a top down view of a five sided polygon shaped structure with Plunger Wave Makers positioned along the straight linear lines of the polygon.

FIG. 13B A detailed view of Plunger Wave Makers 1 placed around a five sided polygon with more than one linear straight line side. The Plunger Wave Makers 1 can be placed along different linear straight-line sides of the polygon. The Plunger Wave Makers 1 can oscillate in sequence with a delayed actuation or they can oscillate in a non sequence manner to push a swell 8 into a body of water on each side of the polygon. Each liner straight line side of the polygon can have a different kind of swell 8 in different directions.

Figure 13C:
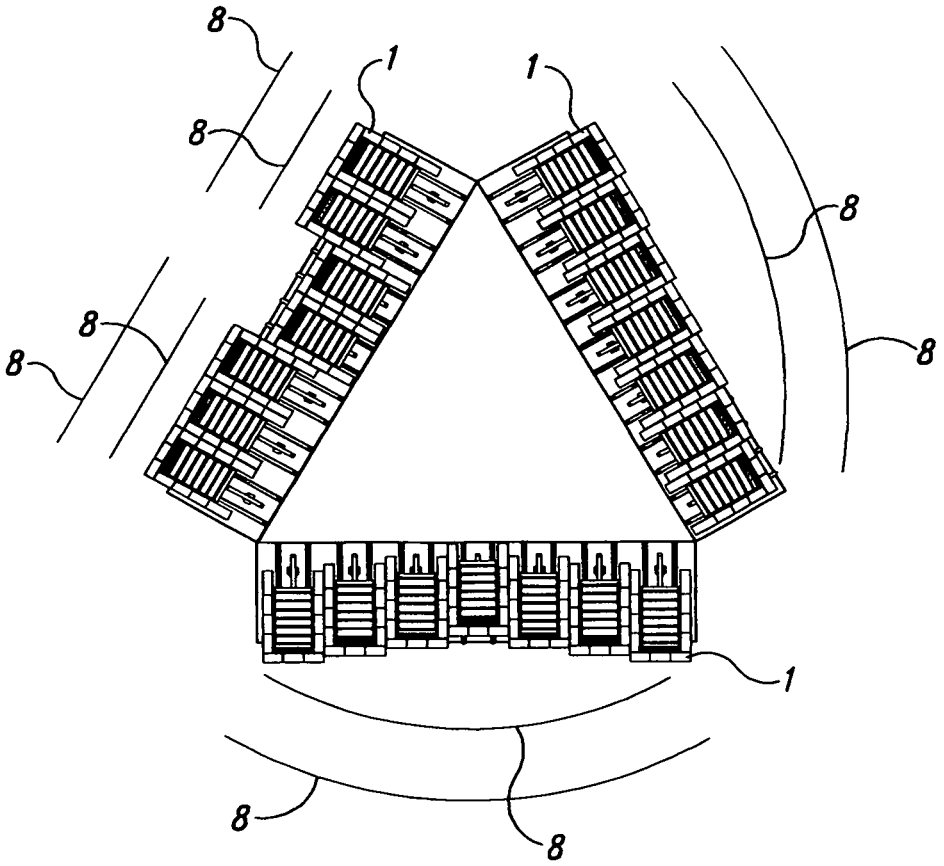
FIG. 13C is a top down view of a three sided triangle shaped structure with Plunger Wave Makers positioned along the straight linear lines of the triangle.

FIG. 13C A detailed view of Plunger Wave Makers 1 placed around a three sided triangle with more than one linear straight line side. The Plunger Wave Makers 1 can be placed along different linear straight-line sides of the triangle. The Plunger Wave Makers 1 can oscillate in sequence with a delayed actuation or they can oscillate in a non sequence manner to push a swell 8 into a body of water on each side of the triangle. Each liner straight line side of the triangle can have a different kind of swell 8 in different directions.

Figure 13D:
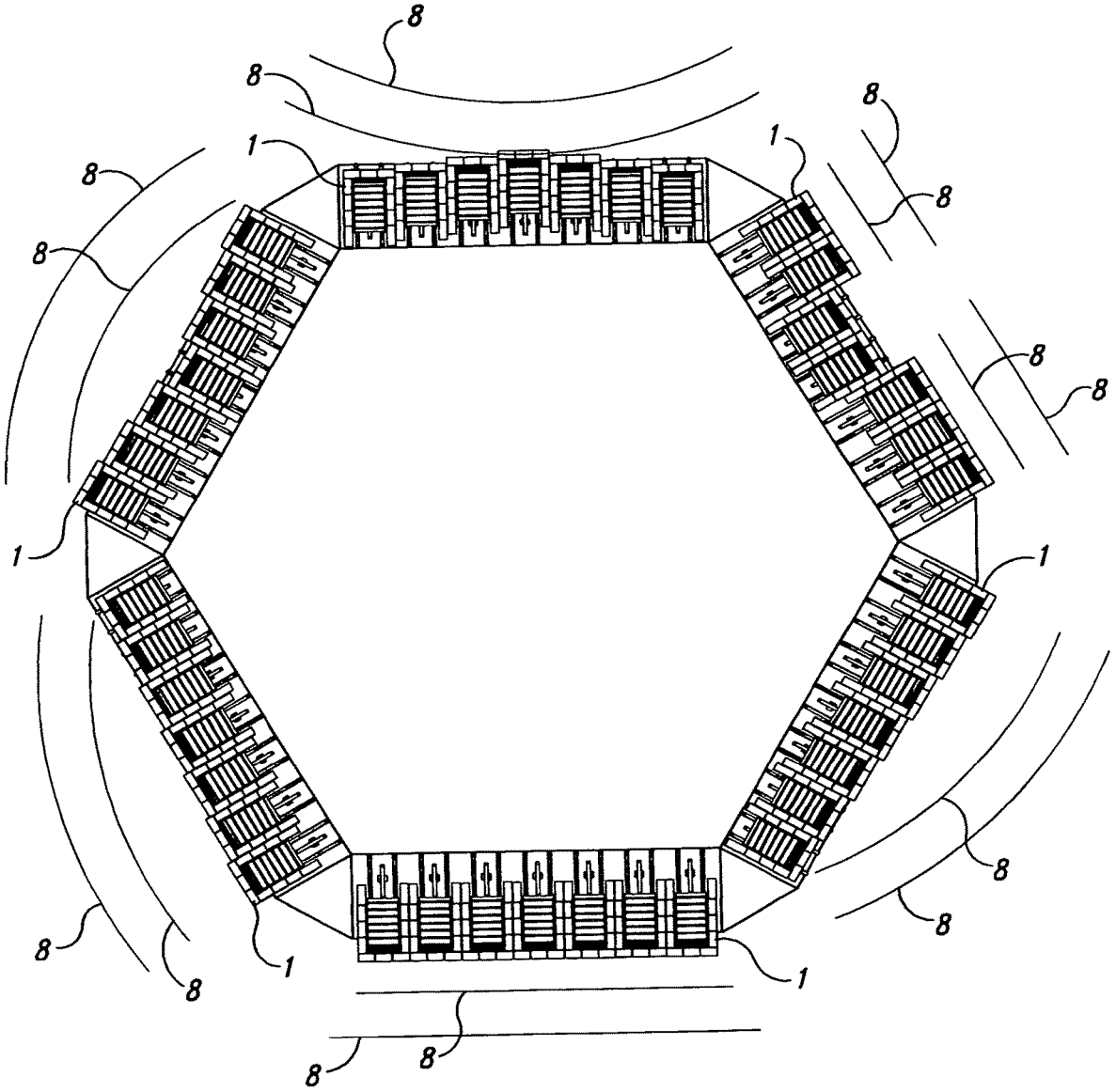
FIG. 13D is a top down view of a six sided hexagon shaped structure with Plunger Wave Makers positioned along the straight linear lines of the hexagon.

FIG. 13D A detailed view of Plunger Wave Makers 1 placed around a hexagon shape with more than one linear straight line side. The Plunger Wave Makers 1 can be placed along different linear straight-line sides of the hexagon. The Plunger Wave Makers 1 can oscillate in sequence with a delayed actuation or they can oscillate in a non sequence manner to push a swell 8 into a body of water on each side of the hexagon. Each liner straight line side of the hexagon can have a different kind of swell 8 in different directions.

The invention claimed is:

1. A plunger wave maker comprising:

a four sided inner steel structure and, wherein the four sided steel structure comprises a front panel, two side panels, a back panel and, wherein the four sided steel structure has expanded polystyrene geofoam attached to an outside of a front, a two sides and, wherein the plunger wave maker is oscillated by a double ended hydraulic actuator and, wherein the plunger wave maker oscillates up and down on a three wheel assembly guide system and, wherein the expanded polystyrene geo foam is attached to the front panel and two side panels of the plunger wave maker by end caps and, a steel stiffeners along the front panel, two side panels and back panel of the plunger wave maker and, a water ballast in the inner steel structure.

2. A plunger wave maker as cited in claim 1 further comprising:

a plurality of side by side individual plunger wave makers oscillating in sequence using a delay between actuation of each individual plunger wave maker to produce a swell into a body of water at different angles to a bottom bathymetry.

3. A plunger wave maker as cited in claim 1 further comprising:

a plurality of side by side individual plunger wave makers oscillating at different times in a non sequence manner using a delay between actuation of each plunger wave maker to produce a swell into a body of water.

4. A plunger wave maker as cited in claim 1 further comprising:

wherein the plunger wave maker is placed on a back wall between 30 and 90 degrees.

5. A plunger wave maker as cited in claim 1 further comprising:

wherein the plunger wave maker can be placed along various shapes and, a linear straight line and, a square shape and, a triangle shape and, a polygon shape and, a hexagon and, shapes with more than one linear straight line side and, wherein a plurality of side by side individual plunger wave makers oscillating to produce a swell in sequence along the sides of the above shapes at different angles to a bottom bathymetry and, wherein a plurality of side by side individual plunger wave makers oscillating to produce a swell in a non sequence manner along the sides of the above shapes to produce a swell toward different directions into a body of water.

* * * * *